US010934114B2

(12) United States Patent
Philips et al.

(10) Patent No.: US 10,934,114 B2
(45) Date of Patent: Mar. 2, 2021

(54) MEDIA LEVEL STATE INDICATOR

(71) Applicant: Hewlett-Packard Development Company, L.P., Spring, TX (US)

(72) Inventors: Jesse Philips, San Diego, CA (US); Matias Negatu, San Diego, CA (US); Alexander M Nameroff, Vacouver, WA (US); John Pruyn, Vancouver, WA (US); Joshua Peter Yasbek, Vancouver, WA (US); Michael A Fairchild, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 14 days.

(21) Appl. No.: 16/332,080

(22) PCT Filed: Sep. 12, 2016

(86) PCT No.: PCT/US2016/051364

§ 371 (c)(1),
(2) Date: Mar. 11, 2019

(87) PCT Pub. No.: WO2018/048451

PCT Pub. Date: Mar. 15, 2018

(65) Prior Publication Data

US 2019/0204772 A1 Jul. 4, 2019

(51) Int. Cl.
*B65H 1/04* (2006.01)
*B41J 13/10* (2006.01)
(Continued)

(52) U.S. Cl.
CPC ..... *B65H 1/04* (2013.01); *B41J 13/103* (2013.01); *B41J 13/106* (2013.01); *B41J 23/12* (2013.01);
(Continued)

(58) Field of Classification Search
CPC ... B65H 1/04; B65H 1/08; B65H 1/14; B65H 1/26; B65H 1/266; B65H 2403/51; B65H 2403/511; G03G 2215/00729
See application file for complete search history.

(56) References Cited

U.S. PATENT DOCUMENTS 5,501,444 A * 3/1996 Yukimachi ..... B65H 1/14 271/127
5,853,171 A 12/1998 Halpenny
(Continued)

FOREIGN PATENT DOCUMENTS

CN 1153329 A 7/1997
CN 1217804 C 9/2005
(Continued)

*Primary Examiner* — Prasad V Gokhale
(74) *Attorney, Agent, or Firm* — Dicke Billig & Czaja PLLC

(57) ABSTRACT

Some examples include a media level state indicator of an image forming apparatus. The media level state indicator including a gear assembly of interconnected gears including a first gear, a second gear, and a cam fixedly disposed on the first gear, the second gear coupled to a media lift system and rotatable with a shaft of the media lift system, the first gear and the cam rotatably coupled to the second gear, a cam follower to selectively contact the cam, the cam follower moveable in response to contacting rotational movement of the cam, and a signal device coupled to the cam follower, the signal device having a first media level state and a second media level state, the signal device to move between the first media level state and the second media level state as the media lift system changes a position of a lift plate.

15 Claims, 5 Drawing Sheets

(51) Int. Cl.

| | |
|---|---|
| ***B65H 1/14*** | (2006.01) |
| ***G03G 15/00*** | (2006.01) |
| ***B41J 23/12*** | (2006.01) |

(52) U.S. Cl.

CPC ..... *B65H 1/14* (2013.01); *G03G 15/6502* (2013.01); *B65H 2403/51* (2013.01); *G03G 2215/00729* (2013.01)

(56) References Cited

U.S. PATENT DOCUMENTS

| | | | | |
|---|---|---|---|---|
| 6,042,103 | A | 3/2000 | Yraceburu et al. | |
| 6,206,362 | B1 | 3/2001 | Tan et al. | |
| 6,422,773 | B1 * | 7/2002 | Lim ..... | B65H 1/14 271/127 |
| 6,622,999 | B1 | 9/2003 | King et al. | |
| 7,091,427 | B2 | 8/2006 | Luque et al. | |
| 7,441,767 | B2 | 10/2008 | Saito | |
| 8,393,613 | B2 | 3/2013 | Chen | |
| 9,278,823 | B2 | 3/2016 | Fujii et al. | |
| 2004/0145107 | A1 | 7/2004 | Luque et al. | |
| 2004/0263542 | A1 | 12/2004 | Eade | |
| 2009/0243192 | A1 | 10/2009 | Okamoto | |
| 2015/0102085 | A1 | 4/2015 | Balili et al. | |

FOREIGN PATENT DOCUMENTS

| | | |
|---|---|---|
| EP | 1024411 | 8/2000 |
| EP | 1816526 | 8/2007 |
| EP | 2634121 | 9/2013 |
| KR | 20020058319 | 7/2002 |

* cited by examiner

MEDIA LEVEL STATE INDICATOR

BACKGROUND

An image forming apparatus, such as a copier or a printer, that forms an image on a sheet of media often includes a media tray that stores a stack of media sheets until the sheets are fed to an image forming portion of the apparatus.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

An image forming apparatus, such as a copier or a printer, that forms an image on a sheet of media often includes a media tray that stores a stack of media sheets until the sheets are fed to an image forming portion of the apparatus. The covered or enclosed media stack is not visible to a user and, as such, a user is unable to tell the status of the media stack without having to remove a cover or open the media tray in which the media stack. In many image forming apparatuses, the only indication the user receives of the status of the media stack is a media-out status signal interruption when the media supply has actually been exhausted. Normally, the signal is issued during a printing or copying job and the image forming operation is interrupted to re-supply the media stack that has been completely exhausted.

Figure 1:
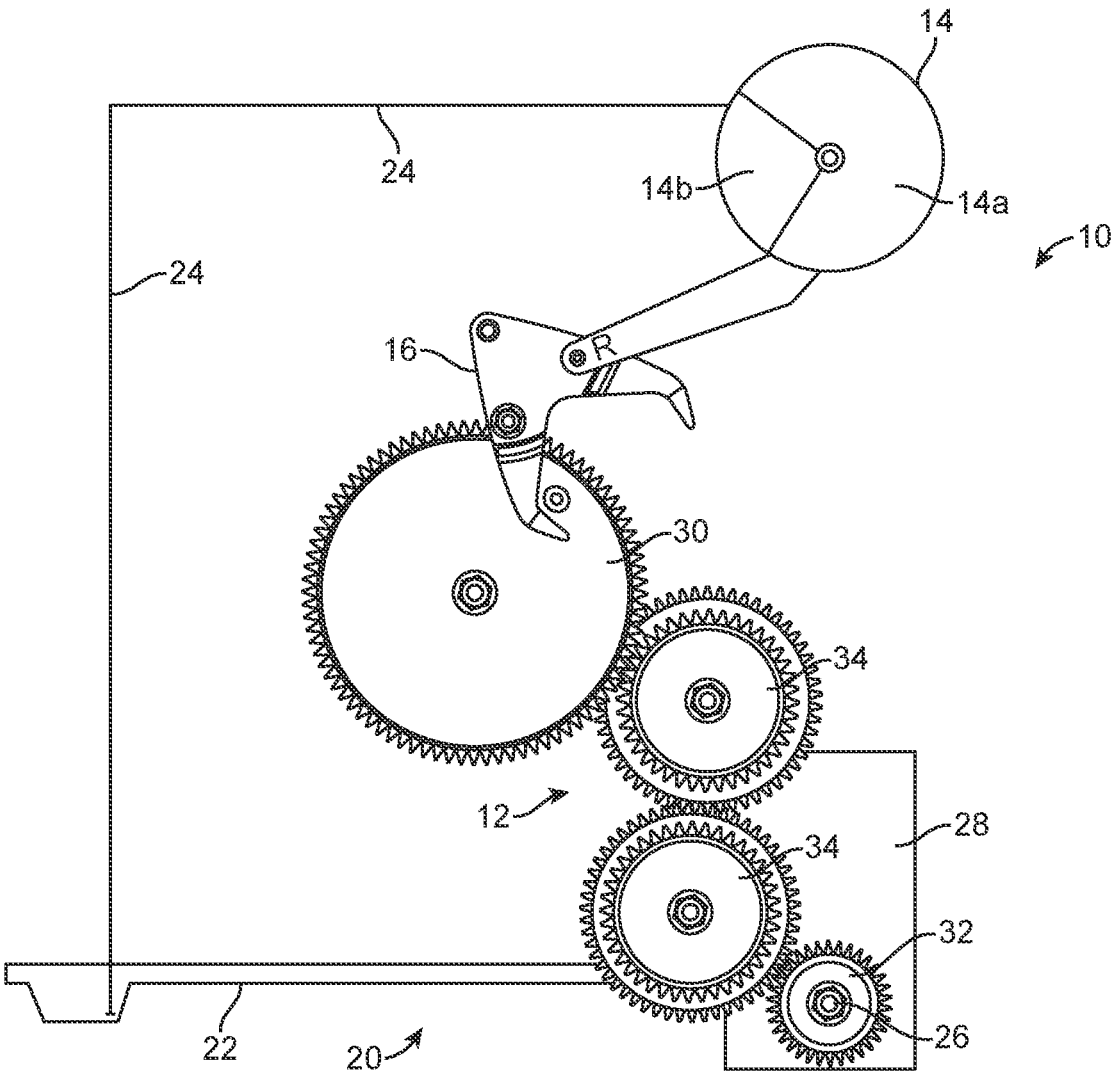
FIG. 1 is a schematic front view of a media level state indicator of an image forming apparatus according to an example of the present disclosure.

FIG. 1 is a schematic front view of a media level state indicator 10 of an image forming apparatus according to an example of the present disclosure. Media status indicator 10 includes a gear assembly 12 and a signal device 14. Gear assembly 12 interacts with a cam follower 16 to maintain or change a state of signal device 14. Signal device 14 is employed to indicate a status of media in image forming apparatus. Media level state indicator 10 is operatively connected to a media lift system 20 as further described below.

In general, as media is removed from a lift plate 22 of a media lift system 20 for processing (e.g., printing or copying), media level state indicator 10 signals a user when media is at a low or insufficient level. Signal device 14 provides visible indication of the media level status on lift plate 22. In general, lift plate 22 forms a platform for stacked sheets of media to be stored prior to printing and for lifting the sheets of media up to a feeding height (position) that each sheet is to be fed to an image forming portion. Media lift system 20 changes a position of lift plate 22. Media lift system 20 includes lift plate 22, a cable 24, a shaft 26, and a torque generator 28. Lift plate 22 is raised, or moved upward, by torque applied from torque generator 28 to cable 24 coupled to lift plate 22. More specifically, cable 24 is attached to lift plate 22 and is wound around a winding pulley (see FIG. 3) attached to shaft 26 that rotates in response to torque from torque generator 28 to raise lift plate 22, thereby lift up the media sheets.

Gear assembly 12 has interconnected gears including a first gear 30, a second gear 32, and at least one intermediate gear 34 with adjacent gears rotatably movable in cooperation with one another. Second gear 32 is coupled to media lift system 20 and, more specifically, second gear 32 is coupled to shaft 26 of media lift system 20. Second gear 32 rotates with shaft 26 as media stacked on lift plate 22 is increased or decreased. Intermediate gears 34 can be included between first and second gears 30, 32 to form an interconnecting series of gears that cooperate together. Cam 36 is fixedly disposed on first gear 30. First gear 30 and cam 36 are rotatable in response to rotation of second gear 32 on shaft 26, and intermediate gears 34, as described further below.

Cam follower 16 of media level state indicator 10 selectively contacts cam 36 as cam 36 is rotated on first gear 30. Cam follower 16 is moveable in response to contacting rotational movement of cam 36. Signal device 14 is operably changeable between at least two states in response to movement of cam follower 36. In one example, signal device 14 includes a first state 14*a* (e.g., sufficient media) and a second state 14*b* (e.g., low media).

Figure 2B:
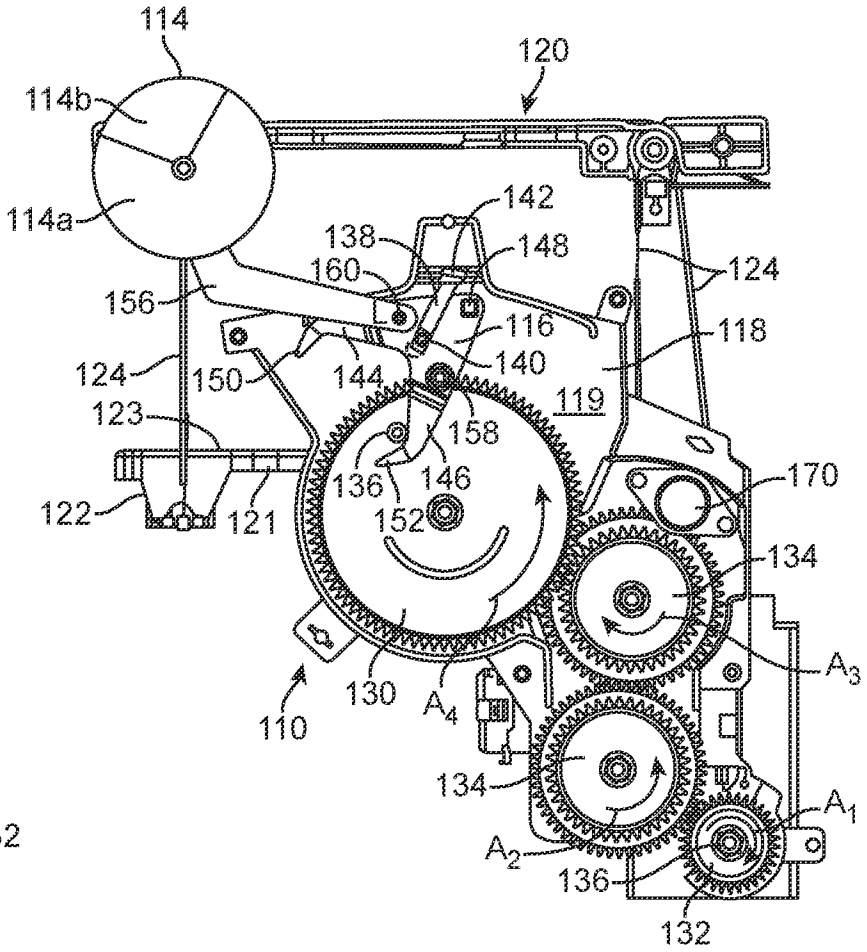
FIG. 2B is a front view of the media level state indicator of FIG. 2A in a second state according to an example of the present disclosure.
Figure 2A:
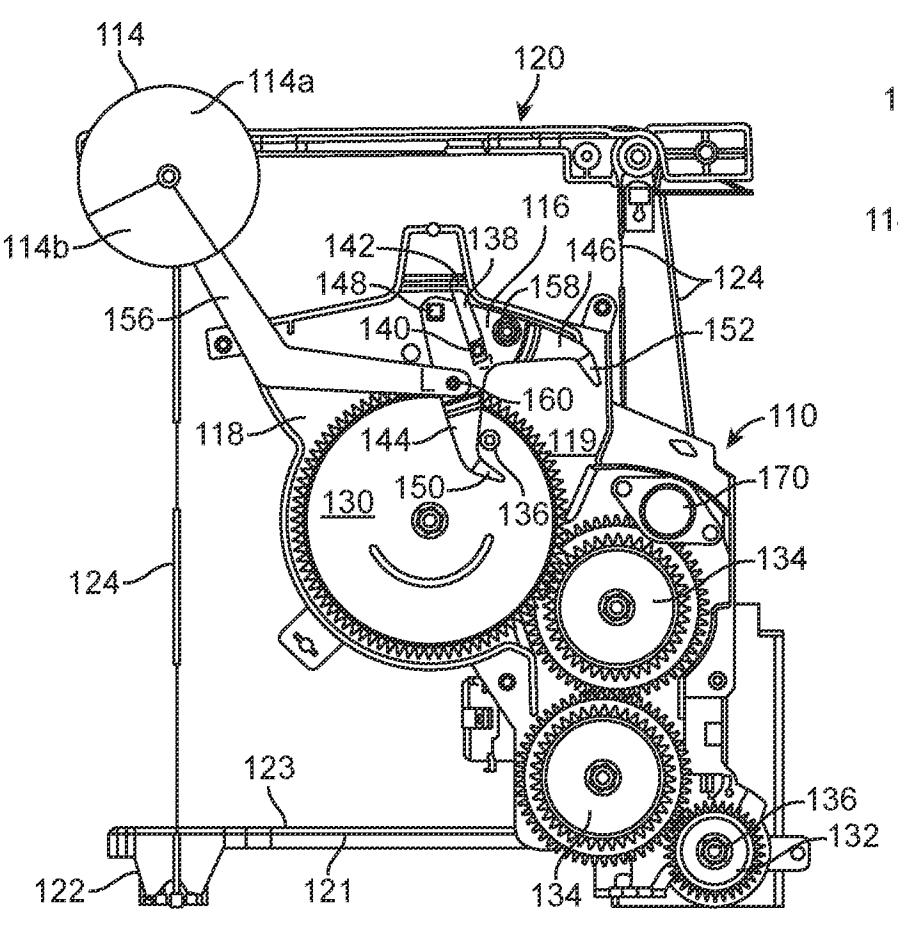
FIG. 2A is a front view of a media level state indicator of an image forming apparatus in a first state according to an example of the present disclosure.

FIG. 2A is a front view of a media level state indicator 110 of an image forming apparatus in a first state according to an example of the present disclosure. First state is indicated with a first zone 114*a* of signal device 114 selectively visible by a user (see also FIG. 4B) and a lift plate 122 of media lift system 120 in a lowered position. FIG. 2B is a front view of a media level state indicator 110 of an image forming apparatus in a second state according to an example of the present disclosure. Second state is indicated with a second zone 114*b* of signal device 114 selectively visible by a user (see also FIG. 4B) and a lift plate 122 of media lift system 120 in a raised position. Media level state indicator 110 is similar to media level state indicator 10 with like elements similarly numbered.

Signal device 114 includes first zone 114*a* and second zone 114*b*, as illustrated in FIGS. 2A and 2B. In one example, signal device 114 can be a circular flag segmented with first state indicated with first zone 114*a* (e.g., first color) and second state indicated with second zone 114*b* (e.g., second color). For example, first zone 114*a* can be blue or green to indicate a first state of sufficient media and second zone 144*b* can be red to indicate a second state of low media. In one example, first zone 114*a*, and thus first state, can occupy a greater surface area than second zone 114*b*, and thus second state. Signal device 114 is movable between first state/zone 114*a* and second state/zone 1114*b* as media is removed from lift plate 122. Signal device 114 in a circular flag form can be rotatably moved between first and second zones 114*a*, 114*b*. Signal device 114 can take the form of any type of indicator capable of alerting a user to a low media condition.

Figure 3:
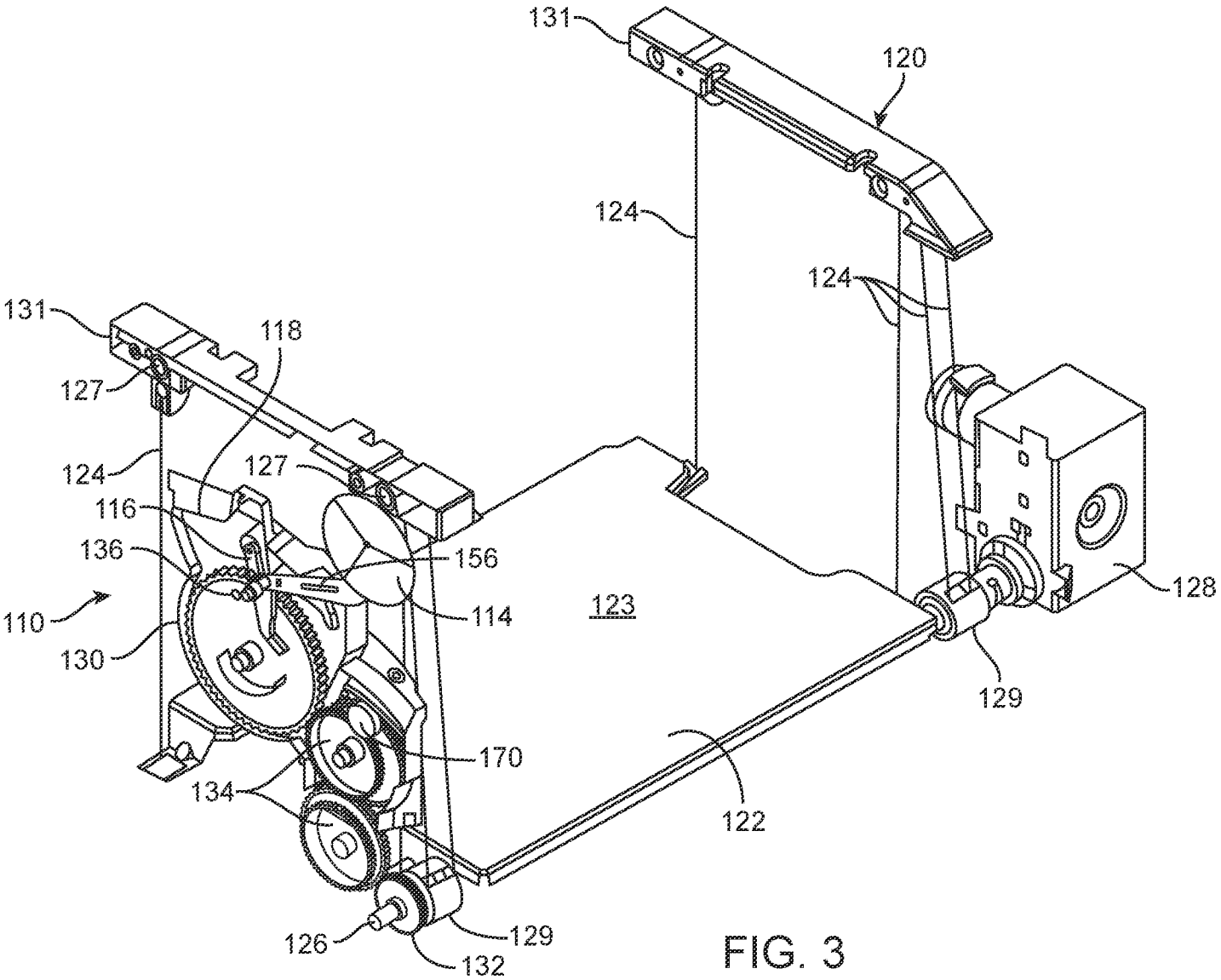
FIG. 3 is a perspective view of the media level state indicator of an image forming apparatus according to the example of FIG. 2A of the present disclosure.

With additional reference to the perspective view of FIG. 3, a support plate 118 can be included with media status indicator 110 to support gear assembly 112 and cam follower 116, for example. Support plate 118 is disposed adjacent to a front edge 121 of a lift plate 122. Gear assembly 112 and cam follower 116 can be moveably attached to support plate 118. Signal device 114 can be rotational attached to support plate 118 or other support. In one example, a main surface 119 of support plate 118 is generally perpendicular to a top surface 123 of lift plate 122. Support plate 118 is maintained in a fixed position within media tray. Intermediate gears 134 can be disposed on support plate 118 between first and second gears 130, 132 to span a desired distance and form a desired gear teeth ratio and rotational movement of a cam 136. Intermediate gears 134 can include multiple sets of gear teeth of varying gear diameters.

Cam follower 116 can be pivotably coupled to support plate 118. Cam follower 116 can be biased to a raised position by a biasing mechanism 138, such as a spring, for example. Biasing mechanism 138 can be attached to support plate 118 with a first end 140 and attached to cam follower 116 with a second end 142. In a biased position, cam follower 116 maintains signal device 114 with a first state 114*a* visible to a user and maintains cam follower 116 extended toward first gear 130 such that cam follower 116 can be contacted by cam 136 as media stack is depleted as first gear 130 is rotated. Continued rotation of cam 136 applies greater force to cam follower 116 than biasing mechanism 138, and cam follower 116 is forced to pivot with rotating cam 136 and first gear 130.

Cam follower 116 can be generally V-shaped, with a first leg 144 and a second leg 146 joined at a vertex 148. First and second legs 144, 146 extend from vertex 148 at an angle from one another. In one example, first and second legs 144, 146 extend at an acute angle from one another. First and second legs 144, 146 can terminate at a first foot 150 and a second foot 152, respectively. Feet 150, 152 can be angled inward toward each other. Each foot 150, 152 forms an obtuse angle with leg 144, 146, respectively. An inner surface of legs 144, 146 and feet 150, 152 form a cam contact surface. Vertex 148 includes an attachment feature for pivotably coupling cam follower 116 to support plate 118. In an initial contact position one of legs 144, 146 of cam follower 116 extends toward first gear 130 such that leg 144, 146, or foot 150, 152, can be contacted with cam 136 in an initial contact position. Cam follower 116 pivots about vertex 148 attachment as cam 136 rotatably contacts legs 144, 146 and feet 150, 152. Cam follower 116 is coupled to a linkage 156 at one of a linkage coupler 158. Linkage coupler 158 can be included on one or both legs 144, 146.

Linkage 156 is attached to either first or second leg 144, 146 at linkage coupler 158. Linkage 156 extends between cam follower 116 and signal device 114 with a first end 160 of linkage 156 coupled to cam follower 116 and a second end (not visible) of linkage 156 coupled to signal device 114. Linkage 156 can be "boomer rang" shaped, curved, or otherwise appropriately shaped to extend between cam follower 116 and signal device 114 and move (e.g., rotate) signal device 114 as cam follower 116 pivots. Attachment of linkage 156 to cam follower 116 can vary with use of a right or a left side signal device 114.

FIG. 2A illustrates media level state indicator 110 in a first state and FIG. 2B illustrates media level state indicator 110 in a second state. With the combined forces of gravity and torque force, as the quantity of media in media stack changes, lift plate 122 is either forced up or down within media tray. For example, with reference to FIG. 2A, when lift plate 122 is filled with media to full capacity, weight of media stacked on lift plate 122 forces lift plate 122 to a bottom position and media level state indicator 114 is in first state 114*a*. As media is processed by image forming apparatus, the weight of media stack decreases, transitioning lift tray 122 upward and media level state indicator to the second state 114*b*.

Lift plate 122 is sized and shaped to accommodate a desired shape and size of media to be positioned on top surface 123 and is of a material of suitable strength and rigidity to support a stack of media (e.g., 500 sheets, 1000 sheets, etc.). Lift plate 122 is a generally planar rectangular plate with four sides and having top surface 123. In one example, lift plate 122 is stamped or otherwise formed of sheet metal into the appropriate shape. Cables 124 can be any suitable flexible material capable of bearing the mechanical operational loads of lift plate 122 and media. In a high capacity image forming apparatus, high strength cables, such as aircraft cables, can be employed.

As illustrated in FIG. 3, media lift system 120 can include at least one driving pulley 127, at least one winding pulley 129, shaft 126, and torque generator 128. Driving pulleys 127 are positioned vertically above lift plate 102 and can be rotatably housed and supported within a pulley assembly 131. It is desirable to maintain lift plate 122 in a flat, horizontal orientation during resting, lift and lowering. In some examples, four cables 124 with corresponding driving pulleys 127 are employed in spaced apart positions to maintain lift plate 122 horizontally. Winding pulley 129 is positioned to wind up a single cable 124 or pair of cables 124 at each of front and back sides of lift plate 122. Shaft 126 is positioned under lift plate 122 and extends between torque generator 128 (e.g., a drive assembly with a motor) and gear 132. Two winding pulleys 129 are attached to a common shaft 126. Winding pulley 129 and shaft 126 are integrally rotated together. In this manner, cables 124 moves lift plate 122 vertically upward and downward while maintaining lift plate 122 in a horizontal position.

As the weight of media on lift plate 122 decreases, torque applied from torque generator 128 rotates shaft 126 and winding pulley 129 to wind cable 124 of media lift system 120 and raise lift plate 122. Engagement between gears of gear assembly 112 results in corresponding rotational movement of adjacent gear(s). In one example, as shaft 126 rotates, second gear 132 disposed on shaft 126 also rotates, causing each of interconnected intermediate gears 134 and first gear 130 to rotate in alternating clockwise, counterclockwise directions. One example of rotational movement of first gear 130, second gear 132, and intermediate gears 134 of gear assembly 112 is indicated by arrows $A_1$, $A_2$, $A_3$, $A_4$ in FIG. 2B.

In transitioning from the first state illustrated in FIG. 2A to the second state illustrated in FIG. 2B, first gear 130, including cam 136, rotates until cam 136 pushes against a leg 144 of cam follower 116. Signal device 114 is rotationally coupled to linkage 156. Linkage 156 is pushed, or pulled, by the pivotal movement of cam follower 116, thereby rotating signal device 114. Media level state indicator 110 in a first state with first zone 114*a* visible to a user, indicates a sufficient status level of media in a media tray until cam 136 contacts and moves, or trips, cam follower 116 thereby triggering signal device 114 to move to a second state 114*b* with second zone 114*b* visible to a user, indicating low media. Signal device 114 transitions to second state, indicating a low media level in media tray. Cam 136 can continue to rotationally move between legs 144, 146 of cam follower 116 as the media level on lift plate 122 continues to decrease.

A user responding to the visual indication by signal device 114 of a second state 114*b* (i.e., low media) can replenish media in media tray. In response to the media stack replenished to a sufficient quantity, lift plate 122 lowers and signal device 114 of media level state indicator 110 is reset to first state 114*a* (i.e., sufficient quantity). More specifically, as lift plate 122 is forced lower by the weight of replenished media supply, cable 124 unwinds from winding pulleys 129, rotating shaft 126. A damper 170 contacts intermediate gear 134 and applies a torque to lift plate 122 when media tray is pulled out from an image forming apparatus to replenish the media. In one example, lift tray drops 10 mm and damper 170 dampens, or slows, further vertical fall of lift tray 122. Damper 170 rotates with intermediate gear 134, constrained by a socket (not shown) such that damper 170 has approximately 10 degrees of rotation. Rotation of shaft 126 in a reverse direction causes reverse rotation of that indicated by arrow $A_1$ of second gear 132 attached to shaft 126 and each of interconnected gears of gear assembly 112, rotationally repositioning cam 136 away from contact with cam follower 116. Cam follower 116 returns to a biased position and signal device 114 is returned to first state 114*a*.

Figure 4B:
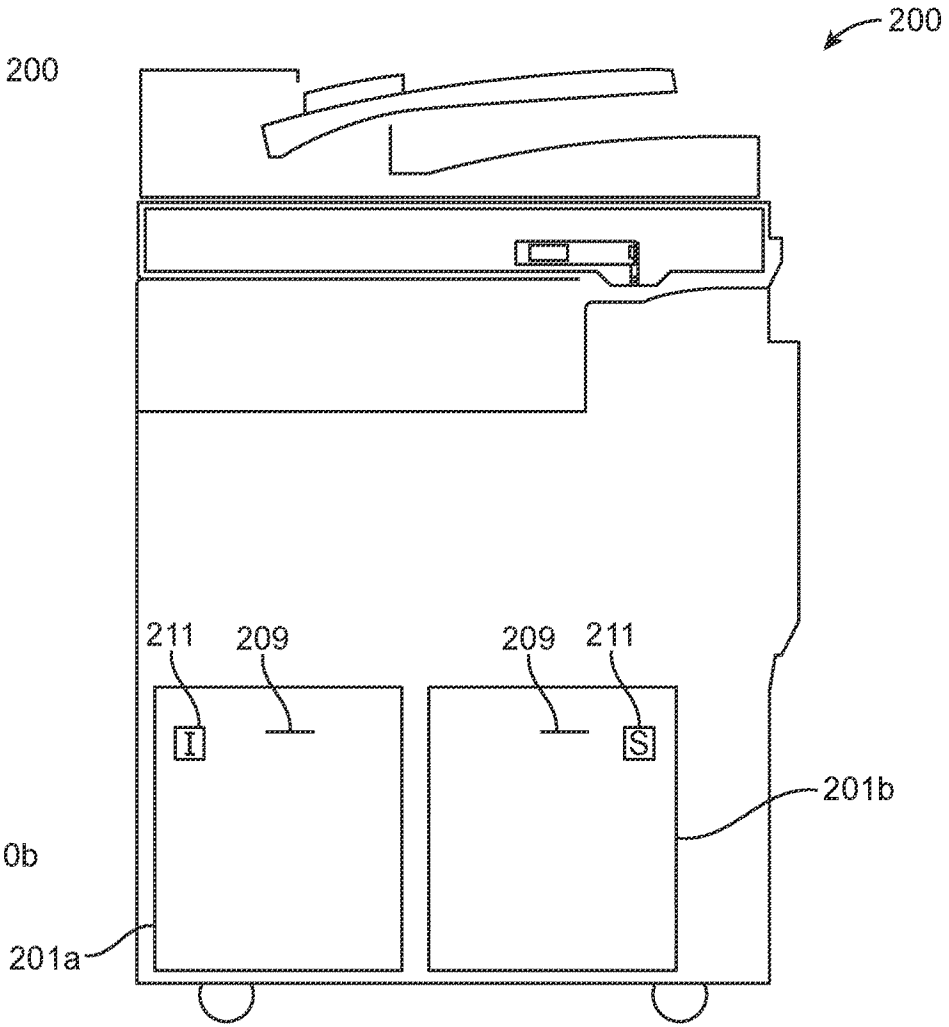
FIG. 4B is an exterior front view of an image forming apparatus including media level state indicators according to the example of FIG. 4A of the present disclosure.
Figure 4A:
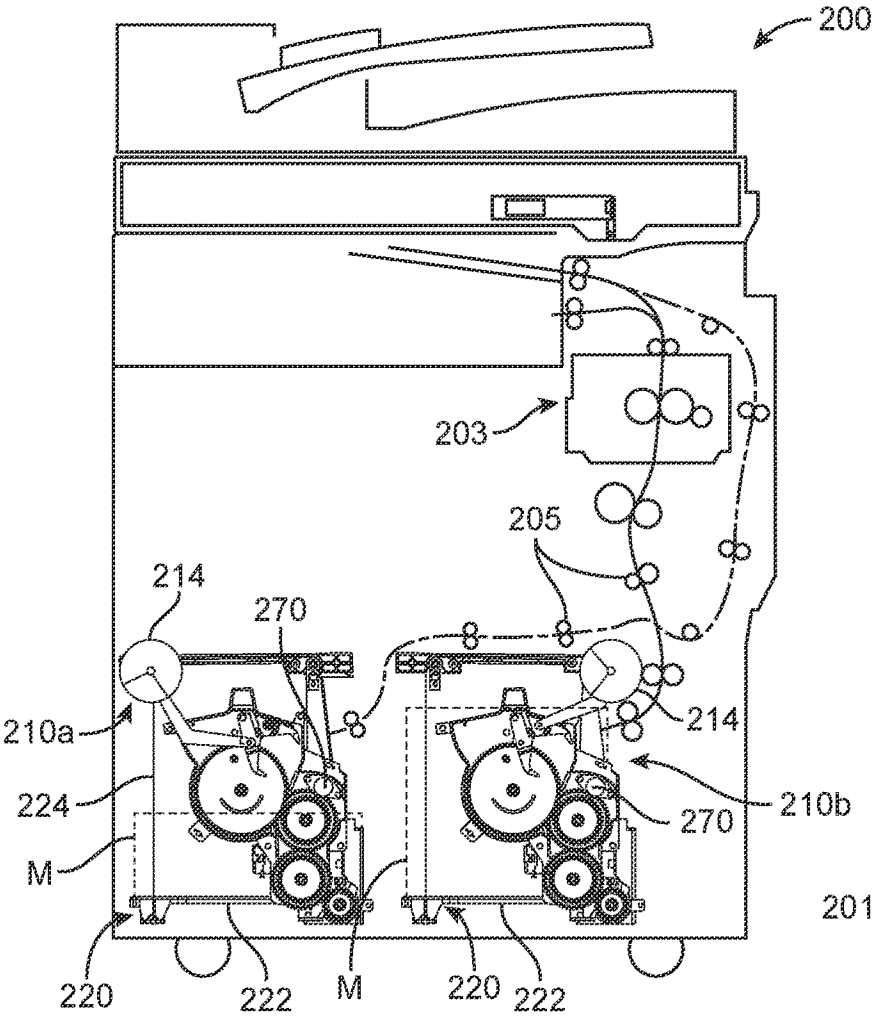
FIG. 4A is an interior front view of an image forming apparatus including media level state indicators according to an example of the present disclosure.

FIGS. 4A and 4B are schematic front views of an image forming apparatus 200 including media level state indicators 210*a*, 210*b* according to an example of the present disclosure. FIG. 4A schematically illustrates an interior front view of image forming apparatus 200 and FIG. 4B schematically illustrates an exterior front view of image forming apparatus 200. Image forming apparatus 200, in one example, is a high capacity printing device wherein a large amount of media sheets "M" can be stored in a media tray 201 until the sheets are fed to an image forming portion 203. Media lift system 220 can function for presenting media "M" for processing within image forming apparatus 200. Media "M" consists of paper, or other media, stacked vertically on a lift plate 222 of media tray 201. In a sheet feeding unit 205 of image forming apparatus 200, an uppermost one of the sheets stored is typically fed out by a feed roller.

Media tray 201 can be pulled out from image forming apparatus 200 to allow a user to replenish a quantity of media "M". More than one media tray 201 can be provided in image forming apparatus 200. For example, two media trays 201 can be provided in tandem (e.g., side-by-side) in some high capacity image forming apparatuses 200, with each media tray 201 capable of storing at least 500 sheets of media "M". Lifting plate 222 is generally provided at the bottom of media tray 201 to stack media "M" upon. Lifting plate 222 is used to lift up the stacked media "M" until an upper-most one of the sheets is positioned to be fed through image forming apparatus 200 to image forming section 203. Lifting and lowering operations of lifting plate 222 is conducted with a media lifting system 220 connected to lifting plate 22 by cables 224 combined with the force of gravity caused by the weight of media "M" on lifting plate 222.

Cable 224 is pulled by the weight of lifting plate 222 in response to lifting plate 222 moving downward from a high position so that shaft 226 is rotated in a direction to unwind (unreel) cable 224, such as when media tray 201 is opened and sheets of media "M" are placed in media tray 201. Gravity, assisted by torque applied by media lifting system 220, is useful in aiding the upward and downward movement of lifting plate 222. Downward movement of lifting plate 222 is generally caused by its own weight and the weight of media "M" stacked thereon. Cable 224 at an initial stage of downward movement is unwound from the high position. Reverse torque is applied to shaft 226 rotate by weight of media on lifting plate 222.

In order to replace a stack of media within media tray 201, a user grasps a handle 209 or other portion of the media tray and pulls it in a direction away from the image forming apparatus. The withdrawal of media tray 201 exposes the media stack and enables its replenishment. In a high capacity image forming apparatus 200 that includes multiple media trays 201*a*, 201*b*, a media level state indicator 210*a*, 210*b* can be provided at each media tray 201*a*, 201*b* and signal device 214 visible at each respective front panel bezel. Signal device 214 provides visible indication of the media level state at media tray 201. Signal device 214 is triggered to transition from first state to second state at a specific, predetermined sheet count, or quantity of media. Once the media stack is replenished to a sufficient level, media level state indicator is reset, or returned to, first state.

In accordance with aspects of the present disclosure, media level state indicator 210*a*, 210*b* is positioned within each media tray 201*a*, 201*b*, respectively, to indicate a media state or quantity of the media in media tray 201*a*, 201*b*. A signal device 214*a*, 214*b* of media level state indicator 210*a*, 210*b*, respectively, gives a user a continuous visual indication of the media level state. Media level state indicator 210*b* can be configured to include signal device displayed on a right side (e.g., see FIG. 1) and media level state indicator 210*a* on a left side (e.g., see FIGS. 2A-2B) of a media tray. A window 211 on a front bezel of media tray can be employed to provide unobstructed visibility of first state (e.g., sufficient media "S") or second state (e.g., low media "I").

Figure 5:
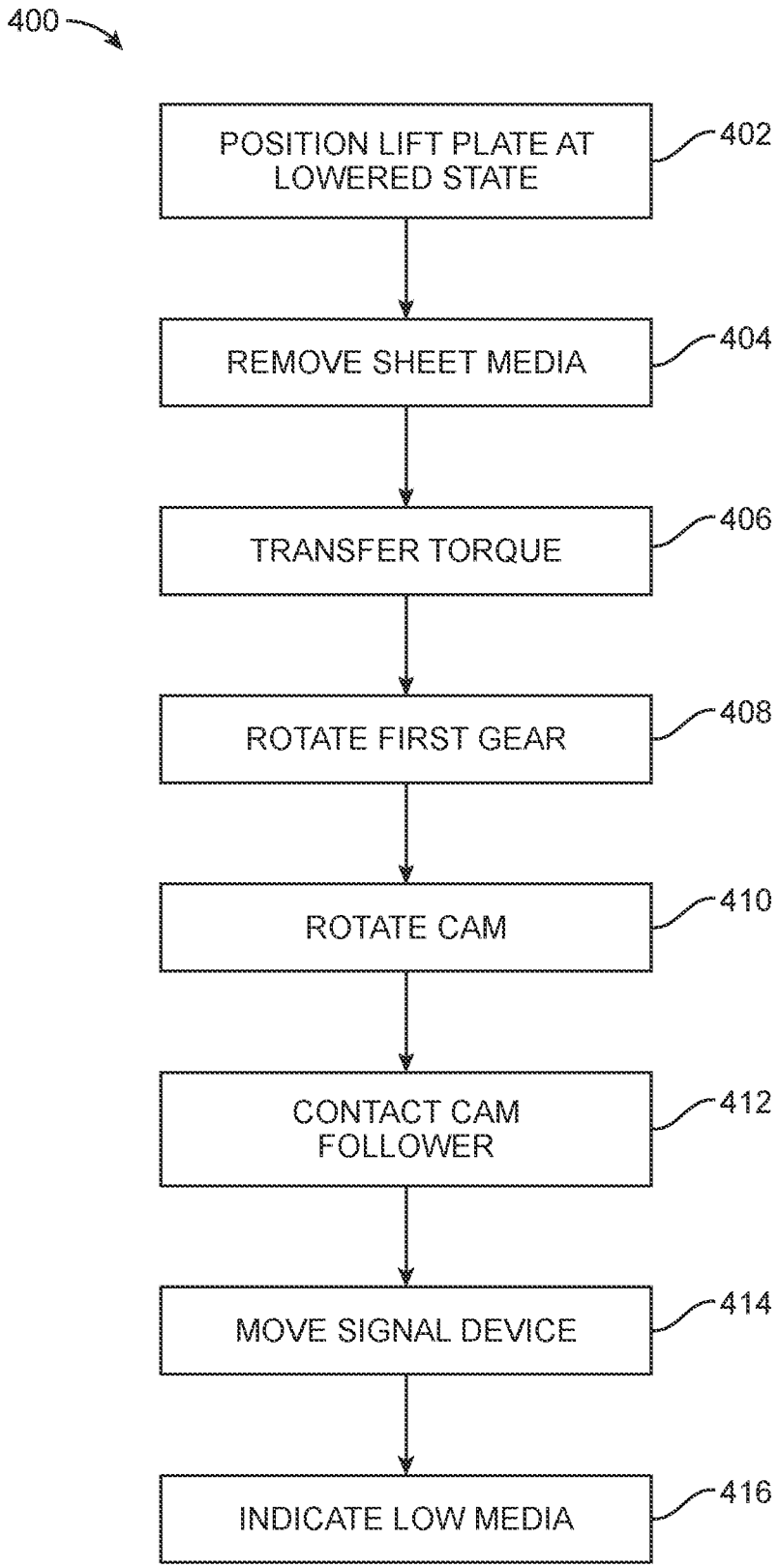
FIG. 5 is a flow chart illustrating an example method to indicate a media level state in a media tray of an image forming apparatus in accordance with aspects of the present disclosure.

FIG. 5 is a flow chart illustrating an example method 400 to indicate a media level state in a media tray of an image forming apparatus in accordance with aspects of the present disclosure. At 402, a lift plate of a media tray having a stack of sheet media is positioned at a lowered state. At 404, sheet media is selectively removed from the media tray. At 406, torque is transferred from a torque generator to a shaft in response to the selectively removed sheet media. At 408, a first gear of a set of interconnecting gears is rotated with the shaft, the first gear disposed on the shaft. At 410, a cam attached to a second gear of the set of interconnecting gears is rotatably moved. At 412, a cam follower is contacted with the cam in an initial contact position. At 414, a signal device is moved from a sufficient media state to a low media state with the cam follower. At 416, the low media state is indicated at the media tray.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A media level state indicator of an image forming apparatus, comprising:

a gear assembly of interconnected gears including a first gear, a second gear, and a cam fixedly disposed on the first gear, the second gear coupled to a media lift system and rotatable with a shaft of the media lift system, the first gear and the cam rotatably coupled to the second gear;

a cam follower to selectively contact the cam, the cam follower moveable in response to contacting rotational movement of the cam; and a signal device coupled to the cam follower, the signal device having a first media level state and a second media level state, the signal device to move between the first media level state and the second media level state as the media lift system changes a position of a lift plate.

2. The media level state indicator of claim 1, wherein the cam follower is biased with a spring.

3. The media level state indicator of claim 1, wherein cam follower is pivotably moveable in response to contact with the cam.

4. The media level state indicator of claim 1, wherein one of the first and second media level states are selectively indicatable to a user.

5. The media level state indicator of claim 1, wherein the gear assembly includes intermediate gears rotatably disposed between the first gear and the second gear.

6. The media level state indicator of claim 1, wherein the gear assembly, the cam follower, and the signal device are supported by a support plate oriented perpendicular to the lift plate.

7. A media tray of an image forming apparatus, comprising:

a housing;

a lift plate disposed in the housing, the lift plate to store media;

a torque generator to produce torque;

a shaft to transfer torque from the torque generator;

a winder pulley coupled to the shaft to transfer torque and rotatably accommodate a lift cable, the lift cable coupled to the lift plate to vertically move the lift plate;

a gear assembly of interconnected gears including a first gear, a second gear coupled to the shaft, and a cam disposed on the first gear;

a cam follower moveable in response to contact with the cam; and a signal device coupled to the cam follower to selectively indicate one of multiple media level states.

8. The media tray of claim 7, wherein the signal device includes a first media level state and a second media level state.

9. The media tray of claim 7, wherein a front panel bezel of the housing includes a window, the signal device selectively indicating one of the multiple media level states at the window.

10. The media tray of claim 7, wherein the cam follower includes a first leg and a second leg coupled to and extending at an angle away from the first leg, the first leg extending toward the second gear, and the second leg coupled to a linkage attached to the signal device.

11. The media tray of claim 10, wherein the cam follower has an inner surface area suitable to contact the cam during a predetermined range of a low media level.

12. The media tray of claim 7, comprising:

a damper disposed in contact with the first gear to apply a torque to the lift plate.

13. A method to indicate a media level state in a media tray of an image forming apparatus, the method comprising:

positioning a lift plate of a media tray having a stack of sheet media at a lowered state;

selectively removing sheet media from the media tray;

transferring torque from a torque generator to a shaft in response to the selectively removed sheet media;

rotating a first gear of a set of interconnecting gears with the shaft, the first gear disposed on the shaft;

rotatably moving a cam attached to a second gear of the set of interconnecting gears;

contacting a cam follower with the cam in an initial contact position;

moving a signal device from a sufficient media state to a low media state with the cam follower; and indicating the low media state at the media tray.

14. The method of claim 13, comprising:

pivoting the cam follower as the cam rotates through a predetermined range of sheet media in the low media state.

15. The method of claim 13, wherein cam is not in contact with the cam follower in the sufficient media state.

* * * * *